US006641371B2

(12) United States Patent
Graziani et al.

(10) Patent No.: US 6,641,371 B2
(45) Date of Patent: Nov. 4, 2003

(54) DEVICE FOR CONTINUOUS REGULATION OF THE GAS FLOW RATE PROCESSED BY A RECIPROCATING COMPRESSOR

(75) Inventors: Franco Graziani, Florence (IT); Piero Morganti, Prato (IT); Andrea Giusti, Pistoia (IT)

(73) Assignee: Nuovo Pignone Holding S.p.A., Florence (IT)

( * ) Notice: Subject to any disclaimer, the term of this patent is extended or adjusted under 35 U.S.C. 154(b) by 0 days.

(21) Appl. No.: 09/941,942

(22) Filed: Aug. 30, 2001

(65) Prior Publication Data

US 2002/0025263 A1 Feb. 28, 2002

(30) Foreign Application Priority Data

Aug. 31, 2000 (IT) ..... MI2000A1931

(51) Int. Cl.[7] ..... F04B 27/04
(52) U.S. Cl. ..... 417/274; 60/641.8
(58) Field of Search ..... 417/266, 274, 417/282, 20, 243, 5, 277, 62; 91/368; 128/205.12; 60/641.8, 281, 150

(56) References Cited

U.S. PATENT DOCUMENTS

| | | | | |
|---|---|---|---|---|
| 2,854,187 A | | 9/1958 | Crooks | |
| 3,084,847 A | | 4/1963 | Smith | |
| 3,838,627 A | * | 10/1974 | Fischer | 91/368 |
| 3,838,941 A | * | 10/1974 | Roschupkin et al. | 417/62 |
| 3,959,983 A | | 6/1976 | Roberts et al. | |
| 3,972,652 A | * | 8/1976 | Minnicino | 417/277 |
| 4,027,993 A | | 6/1977 | Wolff | |
| 4,041,708 A | | 8/1977 | Wolff | |
| 4,232,997 A | | 11/1980 | Grimmer et al. | |
| 4,257,795 A | * | 3/1981 | Shaw | 62/150 |
| 4,453,948 A | | 6/1984 | Fasching | |
| 4,526,513 A | * | 7/1985 | Bogel | 417/5 |
| 4,653,986 A | * | 3/1987 | Ashton | 417/243 |
| 4,775,299 A | | 10/1988 | Overfield et al. | |
| 4,811,558 A | * | 3/1989 | Baugh | 60/281 |
| 4,854,833 A | | 8/1989 | Kikuchi et al. | |
| 4,975,024 A | * | 12/1990 | Heckel | 417/20 |
| 5,195,875 A | * | 3/1993 | Gaston | 417/282 |
| 5,245,836 A | | 9/1993 | Lorentzen et al. | |
| 5,647,730 A | * | 7/1997 | Woollatt | 417/274 |
| 5,732,766 A | | 3/1998 | Hunter et al. | |
| 5,782,612 A | * | 7/1998 | Margardt | 417/266 |
| 5,819,524 A | | 10/1998 | Bosley et al. | |
| 5,850,733 A | | 12/1998 | Bosley et al. | |
| 5,988,165 A | * | 11/1999 | Richey, II et al. | 128/205.12 |
| 6,070,404 A | | 6/2000 | Bosley et al. | |
| 6,321,549 B1 | | 11/2001 | Reason et al. | |
| 6,470,683 B1 | * | 10/2002 | Childs et al. | 60/641.8 |

FOREIGN PATENT DOCUMENTS

| | | |
|---|---|---|
| CH | 254487 | 5/1948 |
| DE | 612250 | 3/1935 |
| FR | 786753 | 3/1935 |

* cited by examiner

*Primary Examiner*—Teresa Walberg
*Assistant Examiner*—Leonid Fastovsky
(74) *Attorney, Agent, or Firm*—Nixon & Vanderhye P.C.

(57) ABSTRACT

A device (10) for continuous regulation of the gas flow rate processed by a reciprocating compressor, wherein the reciprocating compressor has at least one first compression piston (35), which is associated with a first cylinder (51), and can create a pressure which is variable over a period of time, and a second piston (13), which acts inside a second cylinder (52), which is in free communication with the said first compression cylinder (51), associated with the said first piston (35), and which acts on an additional dead space (11). The device includes a third fluid mechanics cylinder (12), which moves the said piston (13) of the dead space (11), wherein the third fluid mechanics cylinder (12) is activated by means of a compressed fluid, supplied by means of an independent hydraulic system (14), in order to obtain continuous variation of the dead space (11).

14 Claims, 2 Drawing Sheets

DEVICE FOR CONTINUOUS REGULATION OF THE GAS FLOW RATE PROCESSED BY A RECIPROCATING COMPRESSOR

BACKGROUND

The present invention relates to a device for continuous regulation of the gas flow rate processed by a reciprocating compressor.

As is known, a reciprocating compressor is an operating machine which returns a compressible fluid (gas or vapour), at a pressure greater than that at which it received the fluid.

The reciprocating compressor operates with at least one cylinder, which communicates at appropriate moments with a delivery environment or with a suction environment; the fluid is sucked from the suction environment, subsequently compressed, and finally discharged to the exterior.

In this context, the need to reduce the flow rate of the gases processed by a reciprocating compressor in relation to its maximum value (100%, or full load), without varying the number of reciprocations, is a requirement which occurs quite frequently.

In particular, the variation of gas flow rate in reciprocating compressors can take place in the following manners: firstly discontinuously, which means with the possibility of being stabilised only at predetermined "steps", or values of flow rate.

Secondly, the variation of gas flow rate can take place continuously, i.e. with the possibility of covering any value as required, within the field of regulation.

With particular reference to the state of the art, it should be noted that at present, the flow rate of reciprocating compressors is regulated by means of the following systems.

The first known system comprises recirculation of the flow rate by means of a by-pass valve; in fact, this system consists of having the flow rate, which is in excess of that required, recirculated from the delivery of the compressor to the point of suction, by means of the assistance of a regulation valve.

However, this system has the disadvantage that all the energy expended must be dissipated, in order to compress the recirculated flow.

A second system according to the known art consists of choking the effects, understood as the action of one or two surfaces of the piston, by means of use of appropriate valve lifters.

In fact, in this known system, the regulation is carried out by deactivating one or more cylinders of the compressor, thus mechanically preventing the suction valves from reclosing during the phase of compression of the cylinder, by means of some devices which are known as valve lifters.

By this means, the compressed gas flows back from the cylinder to the suction line, throughout the compression phase.

However, there is a loss of energy during the phase of reflux of the gases via the suction valve.

In addition, the flow rate can be regulated only in steps (typically with values of 50%, 75% and 100% of the flow rate), and thus, in most cases, a by-pass must also be added between the points of suction and delivery, if it is wished to obtain more accurate regulation of the flow rate.

A third system according to the known art is based on the concept of delay in closure of the suction valves.

The system consists of delaying closure of the suction valves during the compression phase, by acting mechanically on the said valve lifters.

To summarise, during the compression phase, part of the gas which is present in the cylinder flows back along part of the path of the piston, in the suction line; the delay in closure of the suction valves thus permits continuous regulation of the flow rate.

However, the main disadvantage of this system is the dissipation of energy, caused by the reflux of the gases which occurs through the suction valve.

Finally, according to a fourth system, there is insertion of additional dead spaces.

The system consists of additional inhibiting volumes, which are provided in the bases of the cylinders.

This permits regulation of the flow rate in steps, in the case of switching on/off, or continuously, if continuous variation of its volume takes place.

In this last case, the dead space consists of a cylinder (in free communication with the compression cylinder), in which there slides a piston, the displacement of which gives rise to variation of the volume of the dead space itself.

By this means, to each position of the piston there corresponds a value of the dead space, and thus a flow rate value.

Owing to the absence of restrictions between the compression cylinder and the inhibiting volume, the energy expended in order to compress the gas which remains in this volume is fully restored in the re-expansion without significant losses.

Continuous activation of the dead spaces makes it possible to adapt the flow rate to the actual requirement, throughout the field of regulation, thus preventing the energy losses which are associated with the recirculation of part of the flow rate by means of a by-pass, volume increaser, or valve closure return.

At present, bases are provided for cylinders, with dead spaces which are variable continuously only by means of manual actuation, by using flywheels which, by means of a manoeuvring screw, position the piston which closes the base of the cylinders.

SUMMARY OF THE INVENTION

The object of the present invention is thus to provide a device for continuous regulation of the gas flow rate processed by a reciprocating compressor, which eliminates the above-described disadvantages, thus making it possible to prevent undesirable dissipations of energy.

Another object of the present invention is to indicate a device for continuous regulation of the gas flow rate processed by a reciprocating compressor, which makes it possible to eliminate the said valve lifters.

A further object of the present invention is to indicate a device for continuous regulation of the gas flow rate processed by a reciprocating compressor, which permits total or partial exclusion of the recirculation valves.

Another object of the present invention is to indicate a is device for continuous regulation of the gas flow rate processed by a reciprocating compressor, which is economical, safe, and reliable.

This object and others according to the invention are obtained by a device for continuous regulation of the gas flow rate processed by a reciprocating compressor, wherein the said reciprocating compressor has at least one first compression piston, which is associated with a first cylinder, and can create pressure which is variable over a period of time, and a second piston, which acts inside a second cylinder, which is in free communication with the said first compression cylinder, associated with the said first piston, and which acts on an additional dead space, characterised in that it includes a third fluid mechanics cylinder, which moves the said piston of the dead space, wherein the said third fluid mechanics cylinder is activated by means of a compressed fluid, supplied by means of an independent hydraulic system, in order to obtain continuous variation of the said dead space.

According to a preferred embodiment of the present invention, the hydraulic system has an oil tank, a pump which is activated by an electric motor, an accumulator, and a pair of on-off directional solenoid valves.

According to another preferred embodiment of the present invention, each of the said directional solenoid valves is supplied with a compressed hydraulic fluid obtained from the said hydraulic system.

In addition, the hydraulic system has a filter and a pressure switch, for each of the said on-off directional solenoid valves.

According to another preferred embodiment of the present invention, the said solenoid valves are controlled by means of a regulator, according to a negative feedback signal obtained in the reciprocating compressor.

More particularly, the negative feedback signal is a signal which indicates the delivery pressure or the flow rate processed.

According to a further preferred embodiment of the present invention, the said device includes a pressure or flow-rate transmitter, in order to send the signal to be regulated, to an electronic controller, which, on the basis of a set-point value previously set, in turn sends a control signal to the said on-off directional solenoid valves.

In particular, according to the set point set in the controller, the solenoid valves make compressed oil flow from one of the two sides of the fluid mechanics cylinder, consequently emptying the other side, and give rise to movement of the piston of the additional dead space, all in order to vary the volume of the said additional dead space, until the said transmitter sends to the said controller a signal which coincides with the set point of the said controller.

The transmitter is connected by means of an electric line to the controller, which is connected by means of an electric line to the said on-off directional solenoid valves, which in turn are connected hydraulically by means of a pair of hydraulic lines to the said fluid mechanics cylinder.

The device for continuous regulation of the gas flow rate can be applied to all compressors with pistons of the reciprocating type, whether the machines are monophase or multi-phase.

Further characteristics of the invention are defined in the other claims attached to the present application.

The particular characteristics and advantages of the device according to the present invention, for continuous regulation of the gas flow rate processed by a reciprocating compressor, will become more apparent from the following description of a typical embodiment of it, provided by way of non-limiting example, with reference to the attached schematic drawings,

DETAILED DESCRIPTION OF THE DRAWINGS

With particular reference to the figures referred to, the device according to the present invention, for continuous regulation of the gas flow rate processed by a reciprocating compressor, is indicated as a whole by the reference number 10.

It should be understood here that the present invention consists of continuous, automatic implementation of the additional dead spaces 11, carried out in a regulated manner by means of use of a fluid mechanics cylinder 12, which moves the piston 13 of the dead space.

Figure 1:
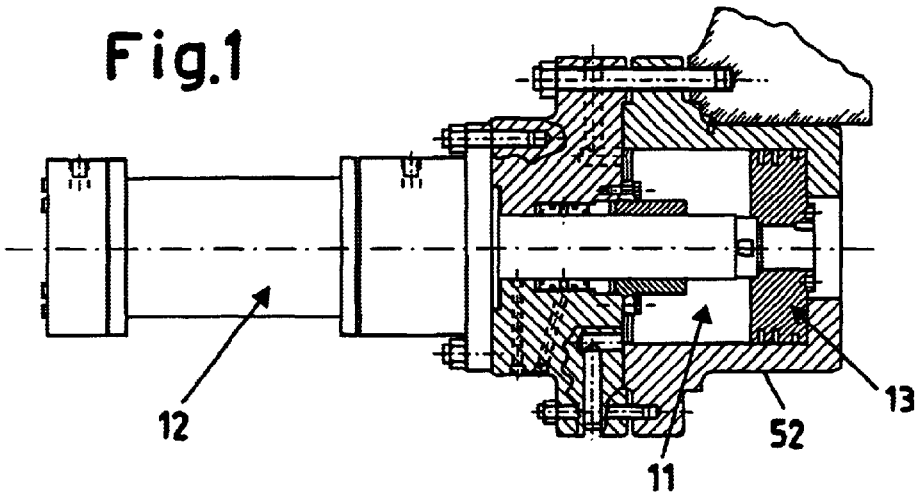
FIG. 1 represents, partially in cross-section, a fluid mechanics cylinder which belongs to the device according to the invention, for continuous regulation of the gas flow rate processed by a reciprocating compressor.
Figure 2:
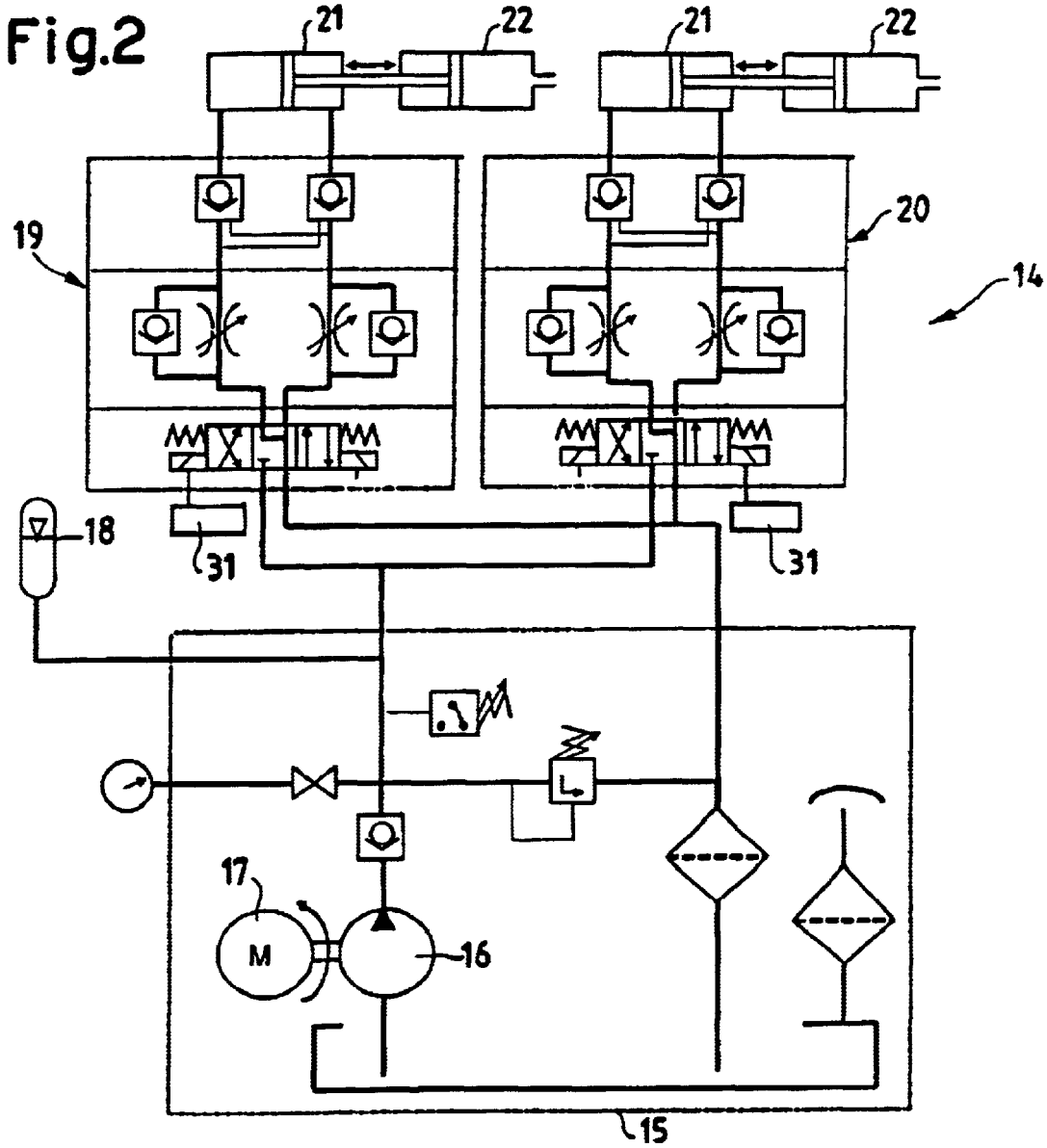
FIG. 2 represents a hydraulic diagram relative to the device according to the present invention, for continuous regulation of the gas flow rate processed by a reciprocating compressor.

In particular, the fluid mechanics cylinder 12 is activated by compressed oil supplied by an independent hydraulic system, which is indicated as a whole by the reference number 14, the hydraulic diagram of which is represented in FIG. 2.

The hydraulic system 14 consists of an oil tank 15, a pump 16 which is activated by an electric motor 17, an accumulator 18, and on-off directional solenoid valves 19 and 20.

The hydraulic system 14 also has a filter 21 and a pressure switch 22, for each of the said on-off directional solenoid valves 19 and 20.

The solenoid valves 19 and 20 are controlled by means of a regulator, according to a negative feedback signal which is obtained in the compressor, and can, for example, be the delivery pressure or the flow rate processed.

The base which is regulated by means of an electro-hydraulic system according to the invention can be applied to all compressors with pistons of the reciprocating type, whether the machines are monophase or multi-phase.

The number of regulated bases to be inserted depends on the number of cylinders of the reciprocating compressor, the degree of regulation required, and the number of phases.

Figure 3:
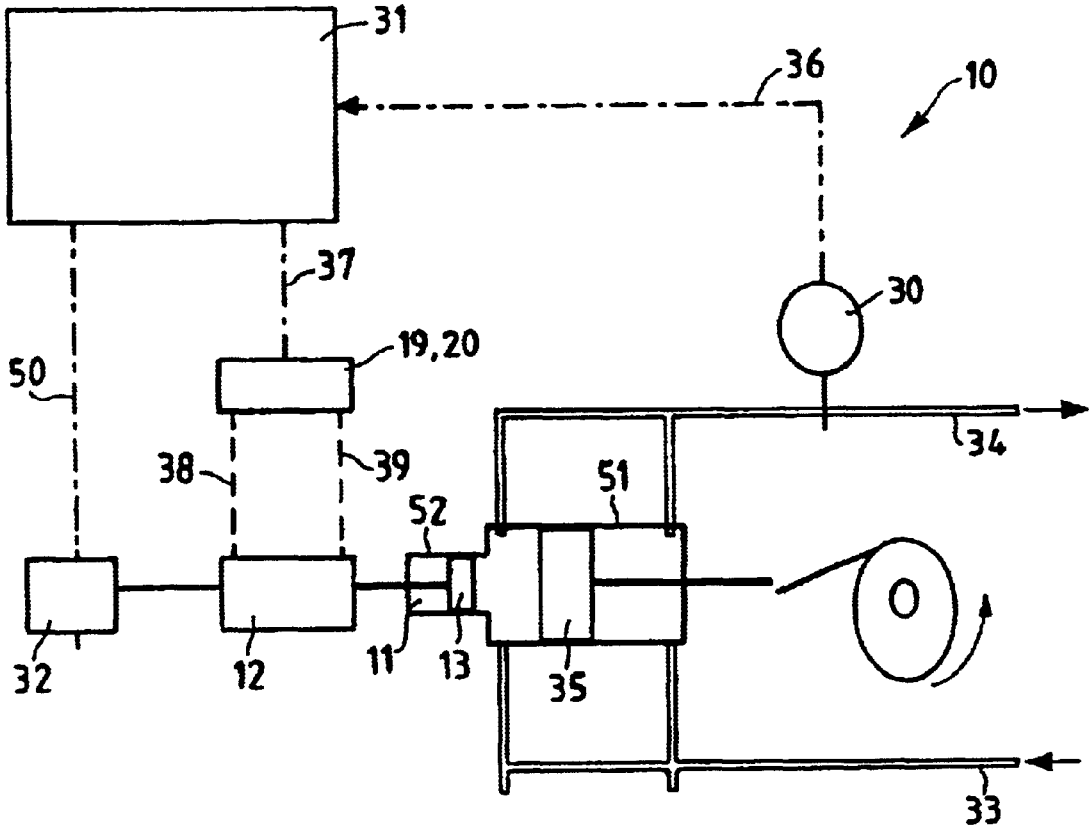
FIG. 3 represents a diagram of the device according to the invention, for continuous regulation of the gas flow rate.

FIG. 3 shows an electro-mechanical and hydraulic diagram of the device 10, in which there can be seen the suction line 33, the delivery line 34, and the piston 35 which belongs to the reciprocating compressor.

In fact, the reciprocating compressor has at least one first compression piston 35, which is associated with a first cylinder 51, and can create a pressure which is variable over a period of time, and a second piston 13, which acts inside a second cylinder 52, in free communication with the said first compression cylinder 51.

The piston 13 acts on the additional dead space 11, and is moved by the fluid mechanics cylinder 12, which in turn is activated by means of the compressed fluid, supplied by means of the independent hydraulic system 14, all such as to obtain continuous variation of the dead space 11.

There is also present a transmitter 30, which can be a pressure or flow-rate transmitter, which is connected by means of an electric line 36 to a controller 31.

The controller 31 is in turn connected by means of an electric line 37 to the on-off directional solenoid valves 19 and 20, which in turn are connected hydraulically, by means of hydraulic lines 38 and 39, to the said fluid mechanics cylinder 12.

A position transmitter 32 for the cylinder 12 is also connected to the controller by means of the line 50.

FIG. 3 also illustrates the functioning of the device 10 for continuous regulation of the gas flow rate.

The transmitter 30 (which, as already stated, can be for the pressure or flow rate) sends the signal to be regulated to the electronic controller 31, which, on the basis of a set-point value previously set, in turn sends a control signal to the directional solenoid valves 19, 20.

Each directional solenoid valve 19, 20 is supplied with compressed hydraulic oil by the hydraulic system 14, consisting of the tank 15, the pump 16 provided with the corresponding motor 17, and the accumulator 18.

According to the set point set in the controller 31, the solenoid valves 19, 20 make a compressed fluid, for example oil, flow from one of the two sides of the fluid mechanics cylinder 12, consequently emptying the other side.

This phenomenon gives rise to movement of the piston 13 of the additional dead space 11, varying the volume of this additional dead space 11, until the transmitter 30 sends the controller 31 a signal which coincides with the set point of the latter.

At this point, the position transmitter 32 of the fluid mechanics cylinder 12 sends the feedback signal to the controller 31.

With reference now to examination of the results obtained according to the present invention, it can be noted that the introduction of the regulation device 10 permits partial or total exclusion of use of the recirculation valve, with a consequent substantial saving in energy.

In some cases, it is also possible to eliminate the valve lifters, if these are already present.

Figure 4:
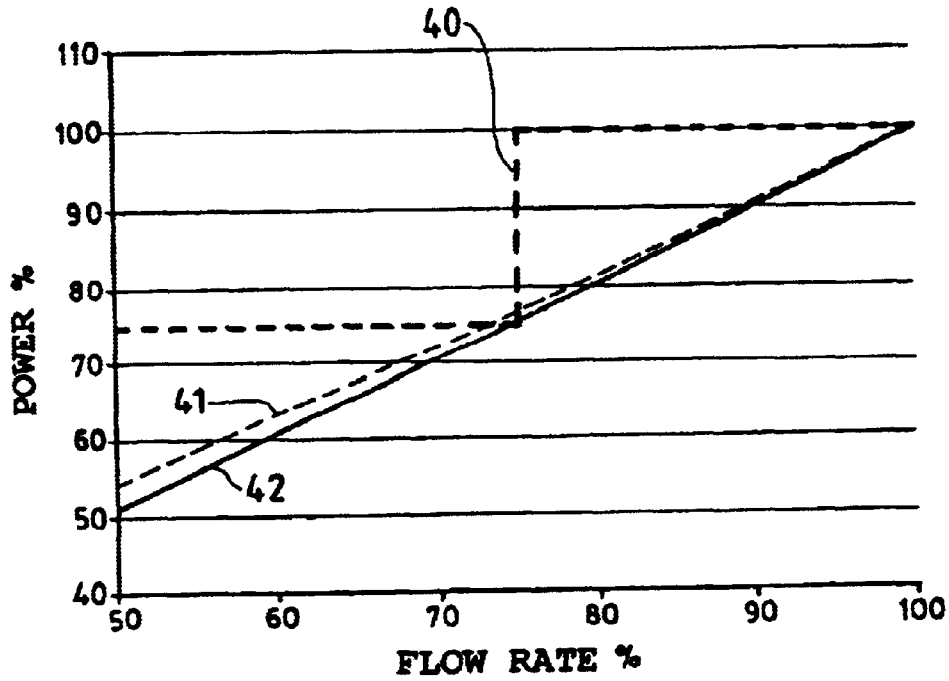
FIG. 4 represents a graph of power used/flow rate, which illustrates the advantages which can be obtained by means of the device according to the invention.

FIG. 4 compares in energy terms the following systems for regulation of the flow rate.

The graph of power required/flow rate illustrated in FIG. 4 shows regulation in steps with valve lifters, indicated by the broken line 40, regulation with a delay in closure of the valves during suction (reflux system), indicated by the broken line 41, and regulation with the dead spaces according to the present invention, indicated by the continuous line 42.

The graph of power required/flow rate shows the advantage which can be obtained by adopting the system with variable inhibiting volumes, in terms of saving of energy absorbed.

The graph in FIG. 4 has been produced for a compressor with average dimensions, with two cylinders, and a phase which processes natural gas, by providing a compression ratio of approximately 3.

The system with variable dead spaces involves an average energy saving of 12%, compared with regulation in steps using valve lifters, and an average saving of 4% compared with the reflux system.

The description provided makes apparent the characteristics and advantages of the device for continuous regulation of the gas flow rate processed by a reciprocating compressor according to the present invention.

The following concluding points and comments are now made, in order to define the said advantages more accurately and clearly.

Firstly, by means of the invention described, it is possible to control the dead spaces accurately, according to the requirements which arise.

In addition, this continuous regulation of the gas flow rate permits substantial energy savings compared with the known art.

Finally, it is possible to reduce the flow rate of the gases processed by a reciprocal compressor, compared with its maximum value (100% or full load), without varying the number of revolutions, all continuously and automatically.

Lastly, it is apparent that many other variations can be made to the device for continuous regulation of the flow rate of gas processed by a reciprocating compressor which is the subject of the present invention, without departing from the principles of novelty which are inherent in the inventive concept.

In the practical embodiment of the invention, any materials, dimensions and forms can be used according to requirements, and can be replaced by others which are technically equivalent.

The scope of the present invention is defined by the attached claims.

What is claimed:

1. A device for continuous regulation of gas flow rate processed by a reciprocating compressor, wherein said reciprocating compressor comprises at least a first compression piston associated with a first cylinder, and able to create a pressure which is variable over a period of time, a second piston, acting independently of said first piston inside a second cylinder, which is in free communication with said first cylinder, and which acts on dead space; in said second cylinder; the device comprising a third fluid mechanics cylinder, which moves said second piston and wherein said third fluid mechanics cylinder is activated by means of a compressed fluid, supplied by means of an independent hydraulic system, in order to obtain continuous variation of said dead space.

2. Device for continuous regulation of gas flow rate, according to claim 1, wherein said independent hydraulic system has a tank for said fluid, and a pump, activated by an electric motor.

3. Device for continuous regulation of the gas flow rate, according to claim 2, wherein said hydraulic system has an accumulator, and at least one pair of on-off directional solenoid valves.

4. Device for continuous regulation of the gas flow rate, according to claim 3, wherein each of said on-off directional solenoid valves is supplied with said compressed hydraulic fluid, obtained from said hydraulic system.

5. Device for continuous regulation of the gas flow rate, according to claim 3, wherein said hydraulic system has a filter and a pressure switch, for each of said on-off directional solenoid valves.

6. Device for continuous regulation of the gas flow rate, according to claim 3, wherein said on-off directional solenoid valves are controlled by means of a regulator, according to a negative feedback signal obtained in said reciprocating compressor.

7. Device for continuous regulation of the gas flow rate, according to claim 6, wherein said negative feedback signal is a signal which indicates the delivery pressure or the flow rate processed.

8. Device for continuous regulation of the gas flow rate according to claim 7, and further comprising a pressure or flow-rate transmitter, adapted to send the signal to be regulated to an electronic controller, which, on the basis of a set point value previously set, in turn sends a command signal to said on-off directional solenoid valves.

9. Device for continuous regulation of the gas flow rate, according to claim 8, wherein according to the set point set in the controller, said on-off directional solenoid valves make said compressed fluid flow from one of the two sides of said fluid mechanics cylinder, consequently emptying the other side, and giving rise to movement of said second piston all in order to vary the volume of said dead space until said transmitter sends said controller a signal which coincides with the set point of said controller.

10. Device for continuous regulation of the gas flow rate, according to claim 8, wherein said transmitter is connected to said controller by means of an electric line.

11. Device for continuous regulation of the gas flow rate, according to claim 10, wherein said controller is connected, by means of an electric liner, to said on-off directional solenoid valves, which in turn are connected hydraulically, by means of a pair of hydraulic lines, to said fluid mechanics cylinder.

12. Device for continuous regulation of the gas flow rate, according to claim 11, wherein said compressed fluid which activates said third fluid mechanics cylinder is oil, supplied by means of said hydraulic system.

13. Device for continuous regulation of the gas flow rate, according to claim 1, wherein said compressor is a monophase or multi-phase compressor.

14. A device for continuous regulation of a gas flow rate processed by a reciprocating compressor, wherein said reciprocating compressor comprises at least a first compression piston associated with a first cylinder, and able to create a pressure which is variable over a period of time;

a second piston, acting independently of said first piston inside a second cylinder, which is in free communication with said first cylinder, and which acts on a dead space in said second cylinder; the device comprising a third fluid mechanics cylinder, which moves said second piston, and wherein said third fluid mechanics cylinder is activated by means of a compressed fluid, supplied by means of an independent hydraulic system, in order to obtain continuous variation of said dead space, and wherein said hydraulic system has an accumulator and at least one pair of on-off directional solenoid valves, each of said on-off directional solenoid valves supplied with said compressed hydraulic fluid, obtained from said hydraulic system.

* * * * *

UNITED STATES PATENT AND TRADEMARK OFFICE

CERTIFICATE OF CORRECTION

PATENT NO. : 6,641,371 B2
DATED : November 4, 2003
INVENTOR(S) : Graziani et al.

It is certified that error appears in the above-identified patent and that said Letters Patent is hereby corrected as shown below:

Column 2,
Line 57, delete “is” after “indicate a”.

Column 6,
Line 18, insert -- a -- after “regulation of”.
Line 25, delete “on dead space;” and insert -- on a dead space --.

Signed and Sealed this

Second Day of March, 2004

JON W. DUDAS
*Acting Director of the United States Patent and Trademark Office*